US009476379B2

(12) United States Patent
Kylström

(10) Patent No.: US 9,476,379 B2
(45) Date of Patent: Oct. 25, 2016

(54) INJECTION UNIT FOR INJECTION OF A FIRST FUEL AND A SECOND FUEL IN A COMBUSTION SPACE

(75) Inventor: Kim Kylström, Tullinge (SE)

(73) Assignee: SCANIA CV AB (SE)

( * ) Notice: Subject to any disclaimer, the term of this patent is extended or adjusted under 35 U.S.C. 154(b) by 887 days.

(21) Appl. No.: 13/805,371

(22) PCT Filed: Jun. 17, 2011

(86) PCT No.: PCT/SE2011/050764

§ 371 (c)(1),
(2), (4) Date: Dec. 19, 2012

(87) PCT Pub. No.: WO2011/162681

PCT Pub. Date: Dec. 29, 2011

(65) Prior Publication Data

US 2013/0092130 A1 Apr. 18, 2013

(30) Foreign Application Priority Data

Jun. 22, 2010 (SE) ..... 1050662

(51) Int. Cl.
*F02M 61/16* (2006.01)
*F02M 61/12* (2006.01)
(Continued)

(52) U.S. Cl.
CPC ..... *F02D 41/3827* (2013.01); *F02M 43/00* (2013.01); *F02M 43/02* (2013.01);
(Continued)

(58) Field of Classification Search
CPC .. F02M 61/168; F02M 47/027; F02M 61/18; F02M 61/16; F02M 61/12; F02M 43/04; A01G 25/023; B05B 1/3006
USPC ..... 239/533.1, 533.2
See application file for complete search history.

(56) References Cited

U.S. PATENT DOCUMENTS 3,763,832 A 10/1973 Fenne ..... 123/25 C
4,266,727 A * 5/1981 Happel ..... F02M 43/04 239/409

(Continued)

FOREIGN PATENT DOCUMENTS

JP 59-041657 3/1984
JP 63-088266 4/1988

(Continued)

OTHER PUBLICATIONS

International Search Report mailed Sep. 27, 2011 in corresponding PCT International Application No. PCT/SE2011/050764.

(Continued)

*Primary Examiner* — Arthur O Hall
*Assistant Examiner* — Chee-Chong Lee
(74) *Attorney, Agent, or Firm* — Ostrolenk Faber LLP

(57) ABSTRACT

An injection unit (9) for injection of a first fuel ($f_1$) and a second fuel ($f_2$) in a combustion space. The injection unit (9) receives the first fuel ($f_1$) from a fuel source (7) at a high pressure, and a second fuel ($f_2$) from a second fuel source (15) at a lower pressure, an actuator (29) initiates a process of injecting at least the second fuel ($f_2$) in the combustion space, and an injection nozzle (36) injects at least the second fuel ($f_2$) in the combustion space. The injection unit includes a pressure boosting device (40) for increasing the pressure of the second fuel ($f_2$) higher than the pressure in the second fuel source (15) by means of the pressure of the first fuel ($f_1$), before the second fuel is injected.

13 Claims, 5 Drawing Sheets

(51) Int. Cl.

| | |
|---|---|
| ***F02M 61/10*** | (2006.01) |
| ***F02D 41/38*** | (2006.01) |
| ***F02M 43/02*** | (2006.01) |
| ***F02M 43/04*** | (2006.01) |
| ***F02M 45/08*** | (2006.01) |
| ***F02M 47/02*** | (2006.01) |
| ***F02M 57/02*** | (2006.01) |
| ***F02M 59/02*** | (2006.01) |
| ***F02M 63/02*** | (2006.01) |
| ***F02M 43/00*** | (2006.01) |

(52) U.S. Cl.
CPC ..... *F02M 43/04* (2013.01); *F02M 45/08* (2013.01); *F02M 47/027* (2013.01); *F02M 57/026* (2013.01); *F02M 59/022* (2013.01); *F02M 61/10* (2013.01); *F02M 63/0285* (2013.01)

(56) References Cited

U.S. PATENT DOCUMENTS 4,612,905 A 9/1986 Dietrich et al. ..... 123/575
4,732,114 A * 3/1988 Binder ..... F02B 47/02 123/1 A
4,782,794 A * 11/1988 Hsu ..... F02D 19/04 123/23
5,170,751 A * 12/1992 Tosa ..... F02B 47/02 123/25 C
5,174,247 A * 12/1992 Tosa ..... F02B 47/02 123/25 C
5,176,120 A * 1/1993 Takahashi ..... F02M 45/00 123/446
5,235,954 A * 8/1993 Sverdlin ..... F02D 7/00 123/447
5,438,968 A * 8/1995 Johnson ..... F02D 17/02 123/446
5,441,028 A * 8/1995 Felhofer ..... F02M 51/00 123/456
5,441,029 A * 8/1995 Hlousek ..... F02M 47/027 123/446
5,529,024 A * 6/1996 Wirbeleit ..... F02M 47/027 123/25 C
5,669,334 A * 9/1997 Schonfeld ..... F02M 43/04 123/25 C
2002/0070295 A1 6/2002 Baker et al. ..... 239/533.3
2006/0065241 A1 3/2006 Yamamoto ..... 123/446

FOREIGN PATENT DOCUMENTS

JP A-H2-64752 5/1990
JP A-H10-299601 11/1998
JP 2009-185609 8/2009

OTHER PUBLICATIONS

English translation of Office Action dated Jan. 28, 2014 issued in corresponding Japanese Patent Application No. 2013-516527.
Chinese Office Action, issued on corresponding Chinese Patent Application No. 201180030449.7, Application date Jun. 17, 2011. English translation. Total 6 pages.

* cited by examiner

INJECTION UNIT FOR INJECTION OF A FIRST FUEL AND A SECOND FUEL IN A COMBUSTION SPACE

CROSS-REFERENCE TO RELATED APPLICATIONS

The present application is a 35 U.S.C. §371 national phase conversion of PCT/SE2011/05076, filed Jun. 17, 2011, which claims priority of Swedish Application No. 1050662-4, filed Jun. 22, 2010, the contents of which are incorporated by reference herein. The PCT International Application was published in the English language.

BACKGROUND TO THE INVENTION AND PRIOR ART

The present invention relates to an injection unit for injection of a first fuel and a second fuel in a combustion space.

A way of reducing the discharge of emissions from combustion engines is to inject the fuel at a very high pressure. A so-called "common rail" system is widely used to effect injection at a high pressure in the combustion spaces of a diesel engine. A common rail system comprises a high-pressure pump which pumps fuel at a very high pressure to an accumulator tank (common rail). The pressure in the accumulator tank during operation may be of the order of 350-1600 bar. The fuel in the accumulator tank is intended to be distributed to all of the engine's cylinders. The fuel from the accumulator tank is injected into the combustion spaces of the respective cylinders via electronically controlled injection units. The injection units comprise valves which have to be able to open and close very quickly. The injection units are controlled by an electrical control unit which calculates substantially continuously the amount of fuel to be supplied to the respective cylinders on the basis of information about various parameters of the engine, e.g. load and speed.

There is increasing interest in using more than one fuel in combustion engines. It is for example of advantage to be able to begin a combustion process with an initial fuel which is readily ignitable and to end with a main fuel which is less readily ignitable, in which case the thermal energy arising from the ignition of the readily ignitable first fuel is used to ignite the less readily ignitable main fuel. This makes it unnecessary to use other types of additives to raise the ignitability of the less readily ignitable main fuel.

Injecting two fuels at high pressure in a combustion engine usually involves using two separate fuel supply systems, viz. a first fuel supply system with a first high-pressure pump which pumps the first fuel to a high pressure in a first accumulator tank (common rail), and a second fuel supply system with a second high-pressure pump which pumps the second fuel to a high pressure in a second accumulator tank (common rail). Thereafter the two fuels can be injected at high pressure from the respective accumulator tanks by means of suitable injection units. US 2002/0070295 refers an example of such an injection unit.

SUMMARY OF THE INVENTION

The object of the present invention is to propose an injection unit which makes it possible to inject two different fuels at high pressure in a combustion engine in which one of the fuels can be delivered to the injection unit by means of relatively simple components.

The above object is achieved with the injection unit of the kind mentioned in the introduction which is characterised by the features disclosed herein. The first fuel source takes with advantage here the form of an accumulator tank (common rail) which contains the first fuel at a high pressure. The first fuel is therefore pressurised with advantage by a high-pressure pump which pumps fuel at a high pressure to the accumulator tank. The second fuel is here subjected to a pressure increase within the injection unit by means of the pressure booster before it is injected into the combustion space. The pressure booster uses here the pressure of the first fuel to pressurise the second fuel. As the second fuel is pressurised within the injection unit, it can be delivered in a relatively low pressure state to the injection unit. There is thus no need to use a high-pressure pump to pressurise the second fuel. The components and lines which deliver the second fuel to the injection unit may be of relatively simple configuration.

According to an embodiment of the present invention, the configuration of the pressure boosting device may be such that it increases the pressure on the second fuel by means of the pressure of the first fuel at times when the actuator is placed in the second position. The pressure boosting of the second fuel is therefore in this case effected only when it is to be injected into the combustion space. The second fuel therefore needs to be kept pressurised for only a short period of time in the injection unit. The configuration of the pressure boosting device may be such that it increases the pressure on the second fuel to higher than that of the first fuel in the first fuel source. Alternatively, the pressure booster may give the second fuel substantially the same pressure as, or a somewhat lower pressure than, that of the first fuel in the first fuel source.

According to another embodiment of the present invention, the pressure boosting device takes the form of a movable means which has on one side a first surface in contact with the first fuel in a first fuel space, and on an opposite side a second surface in contact with the second fuel in a second fuel space. Such a movable means may take the form of a piston or a flexible membrane which is fastened between the first fuel space and the second fuel space. The relationship between said contact surfaces is related to the pressure which the first fuel gives to the second fuel in the second fuel space. When the movable means has for example a larger contact surface with the first fuel than with the second fuel, the second fuel acquires a higher pressure than the first fuel.

According to another embodiment of the present invention, the injection unit comprises a fuel passage which leads the first fuel from the first fuel source to the first fuel space, and a means which is adapted to closing the fuel passage at times when the second fuel is not to be pressurised by the first fuel, and to opening the fuel passage at times when the second fuel is to be pressurised by the first fuel. Such a means can be used to control the pressure of the first fuel in the first fuel space and hence the pressure of the second fuel in the second fuel space. The second fuel therefore need not be at a constant high pressure in the injection unit. Said means may be adapted to closing the fuel passage at times when the actuator is in the first position, and to opening the fuel passage at times when the actuator is in the second position. In this case a pressurisation of the second fuel in the second fuel space is only effected at times when the second fuel is to be injected into the combustion space. The amount of time for which the second fuel is pressurised in the injection unit may therefore be optimally brief.

According to another embodiment of the present invention, said means may comprise said actuator which is arranged to be movable in a recess which extends transversely through part of the fuel passage, and the configuration of the actuator may be such that it closes the fuel passage when it is in the first position and opens the fuel passage when it is in the second position. In this case the actuator is thus used to open and close the fuel passage. The actuator may in this case have running through it a hole which opens said part of the fuel passage when the actuator is in the second position. Alternatively, the actuator may be connected to a valve means or the like which closes and opens the fuel passage according to the position of the actuator.

According to another embodiment of the present invention, the actuator is a shared actuator adapted to initiating injection of both the first fuel and the second fuel. In this case, only one actuator need be activated to inject the first fuel and the second fuel. When the shared actuator is placed in the second position, the injection of the first fuel begins with advantage at a first point in time, and the injection of the second fuel begins at a later point in time, so that the second fuel is injected with a time delay relative to the first fuel. In many cases it is appropriate to begin a combustion process with a readily ignitable first fuel and to end the combustion process with a second fuel which is less readily ignitable. Said time delay may be substantially constant and is related to the amount of time the pressure boosting device takes to increase the pressure of the second fuel to its injection pressure. As the first fuel is already at the necessary injection pressure, it can be injected substantially immediately when an injection process is indicated by said actuator. The second fuel thus has first to undergo a pressure raising process before it can be injected. Such a pressure raising process takes a certain amount of time which depends inter alia, on the specific injection unit's internal flow ducts for the first and the second fuels. The time delay before the second fuel reaches an intended injection pressure therefore remains substantially constant.

According to another embodiment of the present invention, the injection nozzle is a shared nozzle adapted to injecting both the first fuel and the second fuel in the combustion space. In this case, only one injection nozzle need therefore be used to inject the first fuel and the second fuel. The injection unit may comprise a valve mechanism adapted to injecting via the shared nozzle whichever fuel is at the higher pressure when an injection process has been initiated. In this case, the first fuel is thus injected via the shared injection nozzle until the second fuel has reached a higher pressure than that of the first fuel. The injection of the second fuel then takes over until the actuator is moved back to the first position.

According to another embodiment of the present invention, the injection unit comprises an extra actuator to initiate injection of the first fuel, in addition to said actuator which initiates injection of the second fuel. In this case the injection of the first fuel and the second fuel may begin at desired times. It is therefore possible to effect injection of the second fuel with a variable delay relative to the injection of the first fuel. The injection unit may comprise an extra injection nozzle for injecting the first fuel, in addition to said nozzle which injects the second fuel. The injection of the first fuel thus need not cease as soon as the injection of the second fuel begins, and they may be injected in parallel for a brief period of time.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE INVENTION

Figure 1:
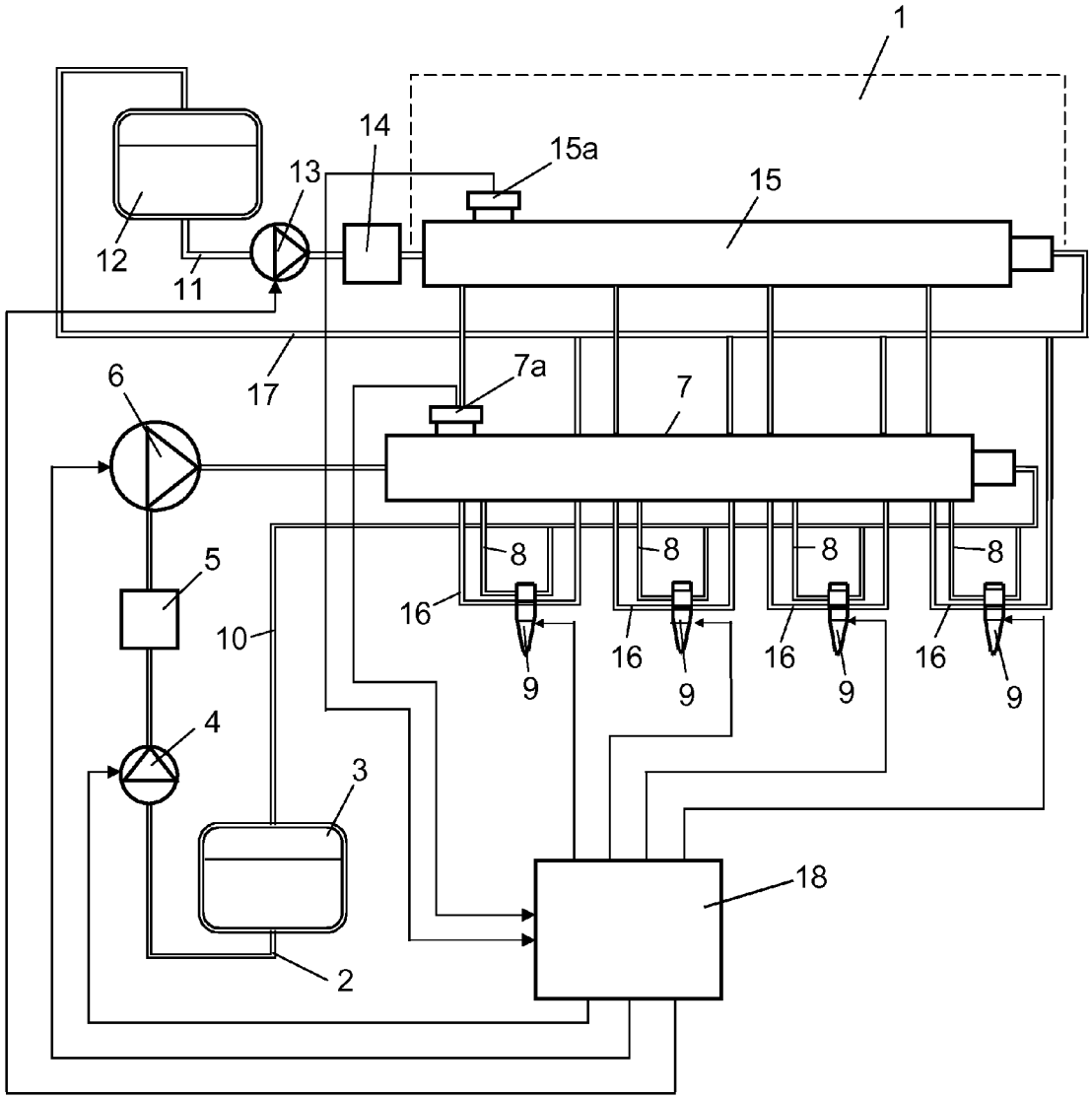
FIG. 1 depicts an injection system with injection units according to the present invention.

FIG. 1 depicts an injection system for injecting two different fuels at a high pressure in a combustion engine 1 which is schematically indicated in the diagram. The engine 1 may be a diesel engine. Injecting the fuels at a high pressure reduces the discharge of emissions from the engine 1. The injection system and the engine 1 may be fitted in a heavy vehicle. The injection system comprises a first fuel system for supplying a first fuel to the engine 1. The first fuel system comprises a first fuel line 2 to supply fuel from a first fuel tank 3. A first feed pump 4 is provided in the first fuel line 2 to transfer the first fuel from the first fuel tank 3 to a high-pressure pump 6 via a filter 5. The high-pressure pump 6 is adapted to pressurising the fuel so that it is fed at a high pressure into a first accumulator tank 7 which takes the form of a so-called common rail. The pressure in the first accumulator tank may be of the order of 350-1600 bar. The first fuel is led from the first accumulator tank 7 to injection units 9 for the respective cylinders of the engine via a number of inlet lines 8. The first injection system comprises a return line system 10 which gathers the first fuel not used for combustion from the first accumulator tank 7 and from the injection units 9, and returns it to the first fuel tank 3.

The injection system comprises a second fuel system for supplying a second fuel to the engine 1. The second fuel system comprises a second fuel line 11 to supply fuel from a second fuel tank 12. A second feed pump 13 is provided in the second fuel line 11 to transfer the second fuel from the second fuel tank 12 via a filter 14 to a second accumulator tank 15 which may likewise take the form of a so-called common rail. The feed pump 13 is used to store the second fuel at a relatively small positive pressure in the second accumulator tank 15. The pressure of the second fuel in the second accumulator tank 15 may be of the order of 4-6 bar. The second fuel is led from the second accumulator tank 15 to injection units 9 in the respective cylinders of the engine 1 via inlet lines 16. The second injection system comprises a return line system 17 which gathers the second fuel not used for combustion from the second accumulator tank 15 and from the injection units 9, and returns it to the second fuel tank 12.

An electrical control unit 18 is adapted to controlling the operation of the first feed pump 4, the high-pressure pump 6, the second feed pump 13 and the injection units 9. The control unit 18 may take the form of a computer unit provided with suitable software for these purposes. A first pressure sensor 7*a* is fitted in the first accumulator tank 7. The first pressure sensor 7*a* is adapted to detecting and to sending signals to the control unit 18 which contain information about the pressure of the first fuel in the first accumulator tank 7. A second pressure sensor 15*a* is fitted in the second accumulator tank 15. The second pressure sensor 15*a* is adapted to detecting and to sending signals to the control unit 18 which contain information about the pressure of the second fuel in the second accumulator tank 15. During operation of the engine 1, the control unit 18 receives control signals substantially continuously concerning parameters of the engine, e.g. its load and speed. The control unit 18 uses this information to calculate the amounts of the first fuel and the second fuel which need to be supplied to the cylinders of the engine 1. The control unit 18 regulates the injection units 9 so that the first fuel and the second fuel are injected into the respective combustion spaces of the engine 1 at desired times and in the calculated amounts.

Figure 2:
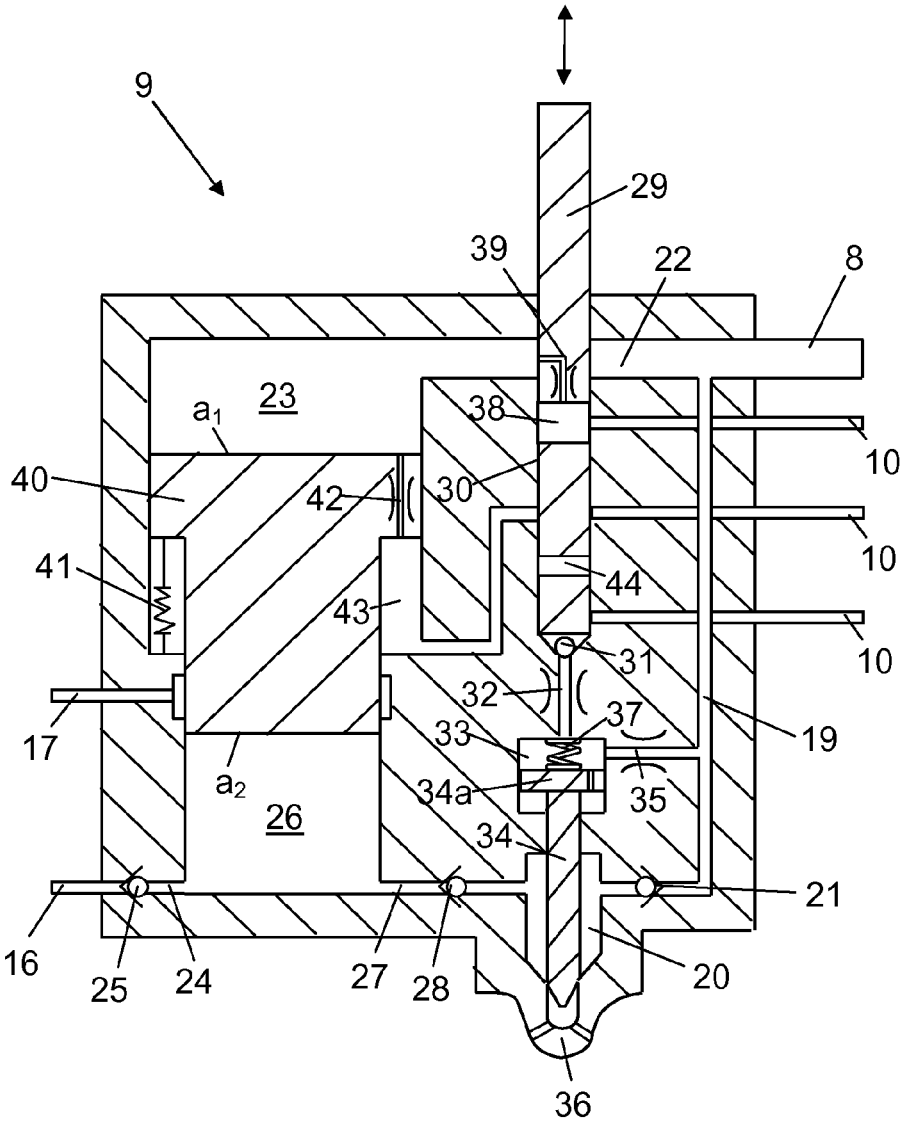
FIG. 2 depicts an injection unit according to a first embodiment of the present invention.

FIG. 2 depicts one of the injection units 9 in more detail. The first fuel is led from the first accumulator tank 7 to the injection unit 9 via an inlet line 8. In the injection unit 9 the first fuel is led to two fuel ducts 19, 22. The fuel duct 19 leads the first fuel to an injection chamber 20 via a one-way valve 21. In certain circumstances, the first fuel is also led to a fuel space 23 via the fuel duct 22. The second fuel is led from the second accumulator tank 15 to the injection unit 9 via the inlet line 16. In the injection unit 9 this fuel is led to a fuel space 26 via a fuel duct 24 with a one-way valve 25. The second fuel may be led from the fuel space 26 to the injection chamber 20 via a duct 27 and a one-way valve 28.

An actuator 29 is arranged to be movable by a suitable power means to and fro in a recess 30 in the injection unit 9 between an upper position and a lower position. The power means, not depicted in the diagram, may for example be a piezo element. The recess 30 comprises at the lower end a ball valve 31 and a connection to a throttle duct 32. The throttle duct 32 connects the recess 30 to a control chamber 33. The control chamber 33 is divided into an upper portion and a lower portion by a head 34*a* of a needle valve 34. The upper portion of the control chamber 33 is connected to the fuel duct 19 via a throttle duct 35. The needle valve 34 has a lower end so shaped as to close a passage between the injection chamber 20 and an injection nozzle 36 when the needle valve 34 is in a lower position. The injection nozzle 36 comprises a number of suitably shaped apertures for injection of the fuel. A spring means 37 is clamped in the upper portion of the control chamber 33 so that it exerts a spring force which endeavours to move the needle valve 34 down towards the lower position. The actuator 29 has running through it a hole 38 so positioned that it connects the fuel duct 22 to the fuel space 23 when the actuator 29 is in the upper position. When the actuator 29 is in the lower position, the hole 38 is relocated relative to the fuel duct 22 so that the actuator 29 breaks the connection between the fuel duct 22 and the fuel space 23. In this situation the hole 38 establishes in conjunction with a throttle duct 39 a connection between the fuel space 23 and a line in the return line system 10.

A pressure booster in the form of a piston means 40 is provided between the fuel space 23 for the first fuel and the fuel space 26 for the second fuel. The piston means 40 comprises a first surface $a_1$ in contact with the first fuel in the fuel space 23 which is larger than a second surface $a_2$ in contact with the second fuel in the fuel space 26. The piston means 40 is spring-loaded towards an upper position by means of a spring means 41. The piston means 40 comprises a throttle duct 42 so that part of the first fuel in the fuel space 23 is led to a space 43. The actuator 29 has running through it a hole 44 which connects the fuel in the space 43 to a line in the return line system 10 when the actuator 29 is in the upper position. When the actuator 29 is in the upper position, surplus first fuel in the fuel chamber 23 can thus be returned to the first fuel tank 3 via the throttle duct 42, the space 43, the hole 44 and the return line system 10. Similarly, surplus second fuel in the fuel space 26 can be returned to the second fuel tank 12 via a line in the return line system 17.

At times when no fuel is to be injected into the engine 1, the control unit 18 places the actuator 29 in the lower position depicted in FIG. 2. This position of the actuator 29 breaks the connection between the first accumulator tank 7 and the fuel space 23. The pressure in the fuel space 23 therefore drops to considerably lower than that which prevails in the first accumulator tank 7, but the first fuel is led at a substantially unreduced pressure to the injection chamber 20 via the fuel line 19 and the one-way valve 21. The second fuel from the second accumulator tank 15 is led therefrom to the fuel space 26 via the inlet line 16, the fuel line 24 and the one-way valve 25. As the first fuel in the injection chamber 20 is at a considerably higher pressure than the second fuel in the fuel space 26, the second fuel is prevented from being led past the one-way valve 28 and into the injection chamber 20. When the actuator 29 is in the lower position, substantially the same pressure prevails on both sides of the needle valve's head 34*a* in the control chamber 33. The spring means 37 therefore keeps the needle valve 34 in the lower position with a spring force such that its lower end closes the passage between the injection chamber 20 and the injection nozzle 36. When the actuator 29 is in this position, the injection unit 9 therefore injects no fuel in the combustion space.

When the control unit 18 estimates that a fuel injection process is to be effected, it actuates the power means to move the actuator 29 to the upper position. The fact that the throttle duct 32 constricts the fuel flow more than the throttle duct 35 reduces the pressure in the upper portion of the control chamber 33 situated above the needle valve's head 34*a* relative to the pressure in the lower portion of the control chamber 33 situated below the needle valve's head 34*a*. This pressure difference causes the needle valve 34 to move upwards to an upper position. The passage between the injection chamber 20 and the injection nozzle 36 opens and the first fuel is sprayed out at a high pressure in the combustion space.

Moving the actuator 29 to the upper position causes the hole 38 running through it to assume a position in way of the fuel line 22. A fuel passage is thus established between the first accumulator tank 7 and the fuel space 23. The first fuel is supplied to the fuel space 23 in an amount such as to create therein a pressure substantially similar to that prevailing in the first accumulator tank 7. The high pressure of the first fuel causes the piston 40 to move downwards against the action of the spring means 37 so that the second fuel in the fuel space 26 is pressurised by the first fuel in the fuel chamber 23. As the first surface $a_1$ of the piston 40 in contact with the first fuel is larger than its second surface $a_2$ in contact with the second fuel, the second fuel in the fuel chamber 26 acquires a higher pressure than the first fuel in the fuel chamber 23. When the pressure of the second fuel in the fuel chamber 26 becomes greater than the pressure of the first fuel in the injection chamber 20, the one-way valve 28 opens and the second fuel flows into the injection chamber 20. The pressure in the injection chamber therefore rises to higher than that of the first fuel in the fuel line 19.

The one-way valve 21 therefore closes so that the first fuel is prevented from reaching the injection chamber 20. Before the injection chamber 20 has been completely emptied of the first fuel, a mixture of the first fuel and the second fuel may possibly for a very short time be injected into the combustion space. Thereafter only the second fuel is injected into the combustion space via the injection nozzle 36.

When the injection of the second fuel is to cease, the control unit 18 activates the power means to move the actuator 29 to the lower position. This position of the actuator 29 results in substantially the same pressure in the control chamber 33 on both sides of the needle valve's head 34*a*. The spring means 37 therefore moves the needle valve 34 to the lower position so that it closes the passage between the injection chamber 20 and the injection nozzle 36. The injection of the second fuel therefore ceases. At the same time, the hole 38 is relocated relative to the fuel line 22 so that the fuel passage between the first accumulator tank 7 and the fuel space 23 is closed. When the actuator 29 is in the lower position, the hole 38 thus assumes a position such that in conjunction with the throttle duct 39 it connects the fuel space 23 to a line in the return line system 10. The pressure in the fuel space 23 is thus lowered. The spring means 41 moves the piston 40 upwards to the initial position while at the same time the pressure in the second fuel space 26 is lowered.

Figure 3:
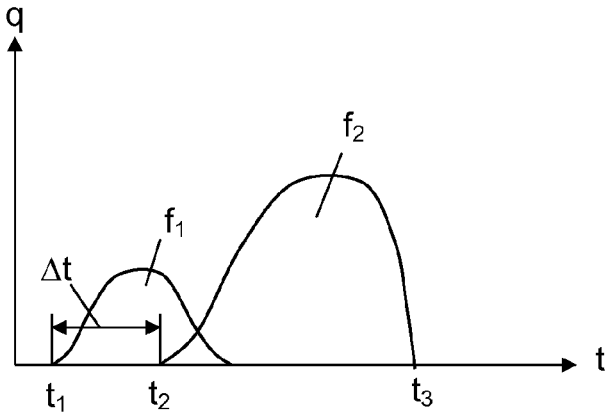
FIG. 3 shows how two different fuels may be injected by the injection unit in FIG. 2.

FIG. 3 shows how the amount of fuel injected q may vary with time t during an injection cycle with the injection unit 9 depicted in FIG. 2. The injection of the first fuel $f_1$ begins at time $t_1$. The injection of the second fuel $f_2$ begins at time $t_2$. The injection of the second fuel ends at time $t_3$. In this case the injection of the second fuel begins with a time delay $\Delta t$ relative to the beginning of the injection of the first fuel. This delay $\Delta t$ is substantially related to the length of time required for the second fuel to become pressurised. This time delay $\Delta t$ is substantially constant and depends inter alia on how the flow passages for the respective fuels are dimensioned in the injection unit 9. In this case the first fuel is a primary fuel added in a smaller amount q than the second fuel which serves as the main fuel. The primary fuel is with advantage a readily ignitable fuel. The ignition of the main fuel, which may thus be significantly less readily ignitable, is therefore facilitated.

Figure 4:
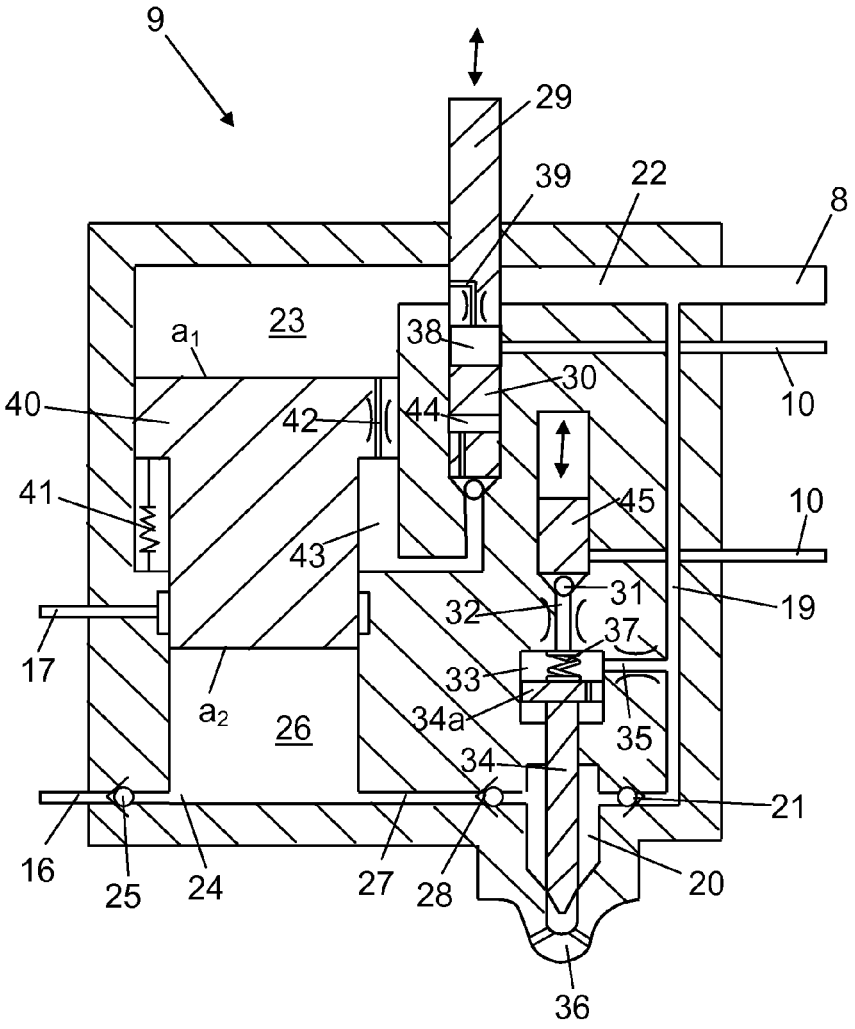
FIG. 4 depicts an injection unit according to a second embodiment of the present invention.

FIG. 4 depicts an alternative injection unit 9 comprising two actuators here referred to as a first actuator 45 and a second actuator 29. The first actuator 45 is used to initiate the injection of the first fuel, and the second actuator 29 to initiate the injection of the second fuel. During operation of the engine, the control unit 18 places the first actuator 45 in a lower position and the second actuator 29 in a lower position, when no fuel is to be injected into the engine 1, as depicted in FIG. 4. The first fuel is thus transferred from the first accumulator tank 7 to the injection chamber 20 via the inlet line 8, the fuel line 19 and the one-way valve 21. The second fuel is transferred from the second accumulator tank 15 to the fuel space 26 via the inlet line 16, the fuel passage 24 and the one-way valve 25. As the first fuel is at a much higher pressure in the injection chamber 20 than the second fuel in the fuel space 26, the second fuel cannot be led past the one-way valve 28 to the injection chamber 20. When the first actuator 29 is in the lower position, substantially the same pressure prevails on both sides of the needle valve's head 34*a* in the control chamber 33. The spring means 37 therefore keeps the needle valve 34 in the lower position with a spring force such that it closes the passage between the injection chamber 20 and the injection nozzle 36.

When the control unit 18 estimates that the first fuel is to be injected, it initiates activation of an undepicted power means to move the first actuator 45 to the upper position. The pressure in the portion of the control chamber 33 situated above the needle valve's head 34*a* is thus reduced relative to the pressure in the portion of the control chamber 33 situated below the needle valve's head 34*a*. This pressure difference causes the needle valve 34 to move upwards to an upper position. The passage between the injection chamber 20 and the injection nozzle 36 opens and the first fuel is sprayed out at a high pressure in the combustion space via the apertures in the injection nozzle 36. When the second actuator 29 is in the lower position, it prevents pressurised fuel being led from the first accumulator tank 7 to the fuel space 23. When the injection of the first fuel is to end, the control unit 18 activates the power means to move the first actuator 45 to the lower position, resulting in substantially the same pressure in the control chamber 33 on both sides of the needle valve's head 34*a*. The spring means 37 therefore moves the needle valve 34 to the lower position so that it closes the passage between the injection chamber 20 and the injection nozzle 36. The injection of the first fuel therefore ceases.

When the second fuel is to be injected, the control unit 18 initiates activation of an undepicted power means to move the second actuator 29 within a recess 30 in the injection unit 9 to an upper position. This position of the second actuator 29 causes the hole 38 running through it to assume a position in way of the fuel line 22. The first accumulator tank 7 is thus connected to the fuel space 23 via the inlet line 8, the fuel line 22 and said hole 38. Pressurised first fuel from the first accumulator tank 7 therefore flows into the fuel space 23, in which it causes the piston 40 to pressurise the second fuel in the fuel space 26. As the active area $a_1$ of the piston 40 in contact with the first fuel is larger than its area $a_2$ in contact with the second fuel, the second fuel in the fuel space 26 acquires a higher pressure than that of the first fuel in the fuel space 23 and the injection chamber 20. The one-way valve 28 therefore opens and the second fuel is led into the injection chamber 20. The pressure therefore rises in the injection chamber 20 to higher than that of the first fuel in the fuel line 19. The one-way valve 21 therefore prevents the first fuel from reaching the injection chamber 20.

If the injection of the first fuel has ended, the control unit 18 activates the power means to move the first actuator 45 to the upper position so that the needle valve 34 opens. The second fuel is then led from the injection chamber 20 to the injection nozzle 36, which injects it in the combustion space. When the injection of the second fuel is to end, the first actuator 45 is moved to the lower position so that the needle valve 34 closes. The second actuator 29 is with advantage moved to the lower position at the same time. This position of the second actuator 29 causes the hole 38 to assume a position such that in conjunction with the throttle duct 39 it connects the fuel space 23 to a return line 10. The pressure in the fuel space 23 therefore drops. The spring means 41 moves the piston 40 upwards to the initial position while at the same time the pressure in the second fuel space 26 drops to that prevailing in the second accumulator tank 15.

Figure 5:
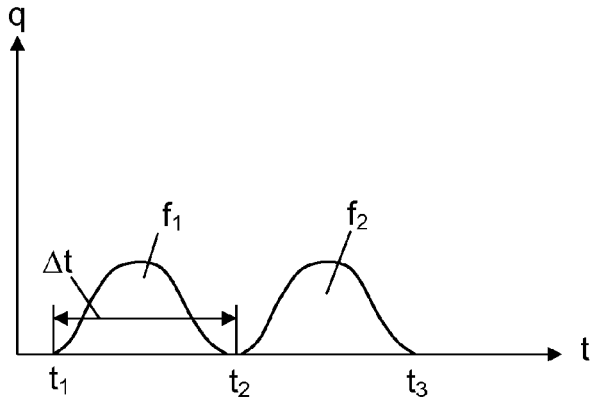
FIG. 5 shows how two different fuels may be injected by the injection unit in FIG. 4.

FIG. 5 shows how the amount of fuel injected q varies during an injection cycle. The injection of the first fuel $f_1$ begins at time $t_1$. The injection of the second fuel $f_2$ begins at time $t_2$. In this case the injection of the first fuel $f_1$ ends before the injection of the second fuel $f_2$ begins. In the example depicted, substantially the same amount q of each fuel is injected. It is however possible to move the second actuator 29 to the upper position at the same time as the first fuel $f_1$ is injected, in which case the injection of the first fuel $f_1$ will end when the second fuel $f_2$ reaches the higher pressure in the fuel chamber 26. Using separate actuators 29, 45 to initiate injection of the respective fuels makes it possible to vary the time delay Δt between the injections of the respective fuels.

Figure 6:
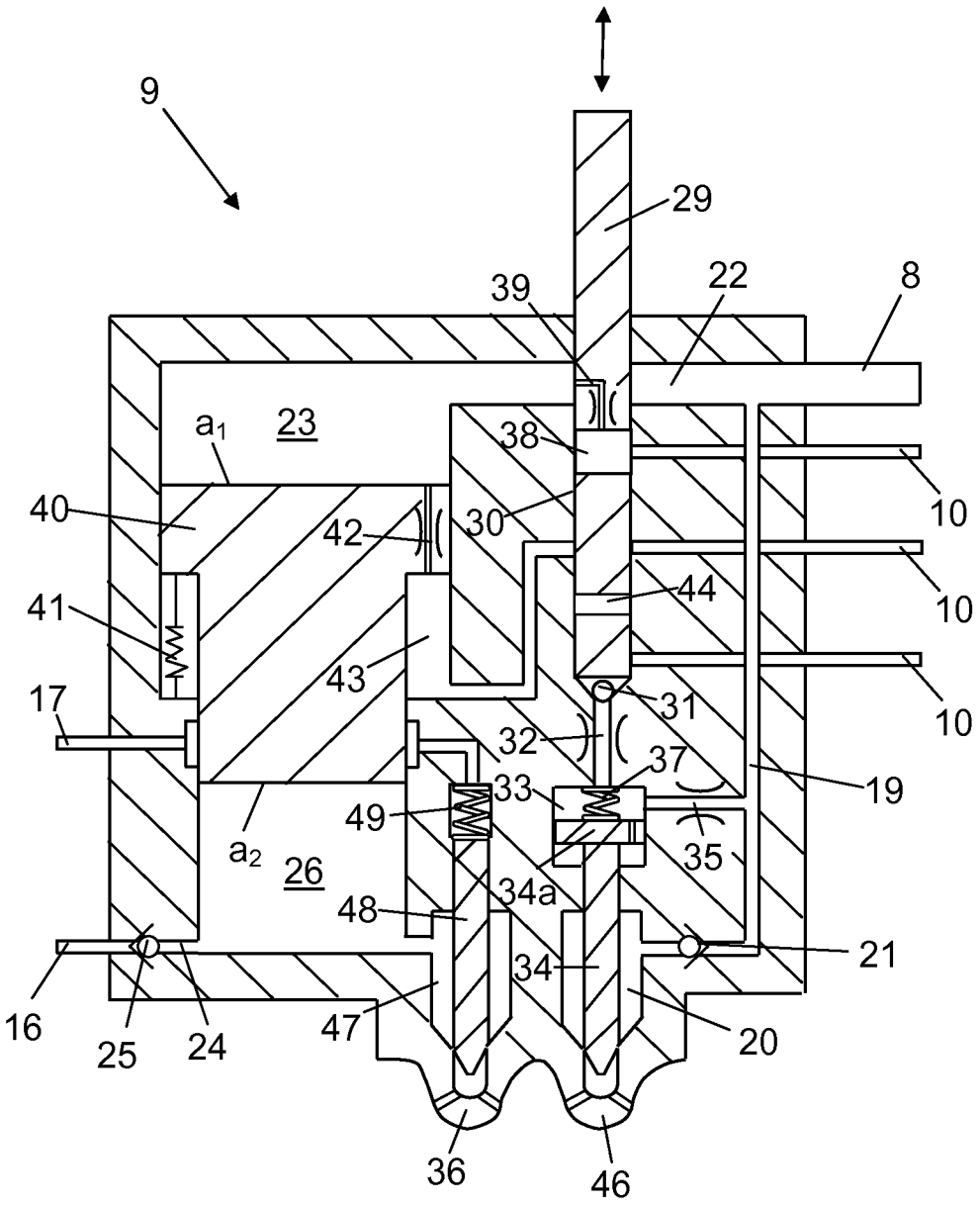
FIG. 6 depicts an injection unit according to a third embodiment of the present invention and FIG. 7 depicts an injection unit according to a fourth embodiment of the present invention.

FIG. 6 depicts a further injection unit 9 which comprises an actuator 29, a first injection nozzle 46 and a second injection nozzle 36. The first actuator 29 is used to initiate the injection of both the first fuel and the second fuel. The first injection nozzle 46 is used to inject the first fuel, and the second injection nozzle 36 to inject the second fuel. At times when no fuel is to be injected into the engine 1, the control unit 18 places the actuator 29 in the lower position depicted in FIG. 6. This position of the actuator 29 breaks the connection between the first accumulator tank 7 and the fuel space 23. The pressurised first fuel can therefore not be led to the fuel space 23. The first fuel is led, however, to the injection chamber 20 via the fuel line 19 and the one-way valve 21. The second fuel is led from the inlet line 16 to the fuel space 26 via the fuel line 24 and the one-way valve 25. When the actuator 29 is in the lower position, substantially the same pressure prevails on both sides of the needle valve's head 34*a* in the control chamber 33. The spring means 37 therefore keeps the needle valve 34 in the lower position by spring force such that its lower end closes the passage between the injection chamber 20 and the first injection nozzle 46. When the actuator 29 is in the lower position, the injection nozzle 46 therefore injects no fuel in the combustion space.

When the control unit 18 estimates that a fuel injection process is to be initiated, it activates an undepicted power means to move the actuator 29 to the upper position. As the throttle duct 32 throttles more than the throttle duct 35, the pressure in the upper portion of the control chamber 33 situated above the needle valve's head 34*a* is reduced relative to that in the lower portion of the control chamber 33 situated below the needle valve's head 34*a*. This pressure difference causes the needle valve 34 to move upwards to an upper position. The passage between the injection chamber 20 and the first nozzle 46 opens and the first fuel is sprayed out at a high pressure in the combustion space. Moving the actuator 29 to the upper position causes the hole 38 running through it to assume a position in way of the fuel line 22. The first fuel is therefore led from the first accumulator tank 7 to the fuel space 23 via the inlet line 8, the fuel line 22 and the hole 38. The first fuel exerts in the fuel space 23 a pressure on the piston 40 causing it to move downwards against the force of the spring means 41. The piston 40 thus pressurises the second fuel in the fuel space 26 by means of the first fuel in the fuel chamber 23. As the first surface $a_1$ of the piston 40 in contact with the first fuel is larger than its second surface $a_2$ in contact with the second fuel, the second fuel in the fuel chamber 26 acquires a higher pressure than the first fuel in the fuel chamber 23. A smaller portion of the fuel in the fuel space 23 is led through a throttle duct 42 to a space 43. When the actuator 29 is in the upper position, a hole 44 running through it assumes a position such that it connects the space 43 to a line in the return line system 10. The first fuel reaching the space 43 is thereupon returned to the first fuel tank 3 when the actuator is in this position.

The fuel space 26 is in this case connected to a second injection chamber 47. The fuel space 26 and the second injection chamber 47 thus contain the second fuel at the same pressure. A second needle valve 48 extends through the injection chamber 47. A spring means 49 is fastened to an upper end of the second needle valve 48. The spring means 49 exerts a spring force which endeavours to move the needle valve 48 towards a lower position. In the lower position the needle valve 48 closes a passage between the second injection chamber 47 and the second injection nozzle 36. When the second needle valve 48 is in the lower position, it thus prevents the second injection nozzle 36 from injecting the second fuel in the combustion space. When the pressure in the fuel space 26 and therefore in the second injection chamber 47 reaches a specific value, the second needle valve 48 moves upwards against the action of the spring means 49. The passage between the injection chamber 47 and the second injection nozzle 36 opens and the second fuel is sprayed at a high pressure in the combustion space. In this case the injection of the second fuel begins with a constant time delay Δt relative to the beginning of the injection of the first fuel. This time delay depends mainly on how quickly the second fuel reaches the pressure required to open the needle valve 48.

This position of the injection of the first fuel is to end, the control unit 18 activates the power means to move the actuator 29 to the lower position. This position of the actuator 29 results in substantially the same pressure in the control chamber 33 on both sides of the needle valve's head 34*a*. The spring means 37 therefore moves the needle valve 34 to the lower position so that it closes the passage between the injection chamber 20 and the injection nozzle 46. The injection of the first fuel therefore ceases. Moving the actuator 29 to the lower position causes the hole 38 to assume a position such that the connection between the first accumulator tank 7 and the fuel space is broken. In this situation, however, the hole 38 establishes a connection between the fuel space 23 and a line in the return line system 10 via a throttle duct 39 which extends through the actuator 29. The pressure in the fuel space 23 is thus lowered. The spring means 41 moves the piston 40 upwards while at the same time the pressure in the second fuel space 26 is lowered. When the pressure in the second fuel space and the injection chamber 47 drops below a predetermined value, the spring means 49 moves the second needle valve 48 to the lower position. The second needle valve 48 closes the passage between the second injection chamber 47 and the second injection nozzle 36 so that the injection of the second fuel ceases. The amounts q and the times at which the injection of the respective fuels begins may for example correspond to what is depicted in FIG. 3 or FIG. 5. In this case the injection of the second fuel begins with a time delay Δt which is substantially constant. The time delay Δt corresponds to substantially the amount of time required for the second fuel to reach the pressure at which the second needle valve 48 opens. In this case the second fuel does not need to be given a higher pressure than the first fuel before the injection of the second fuel begins.

Figure 7:
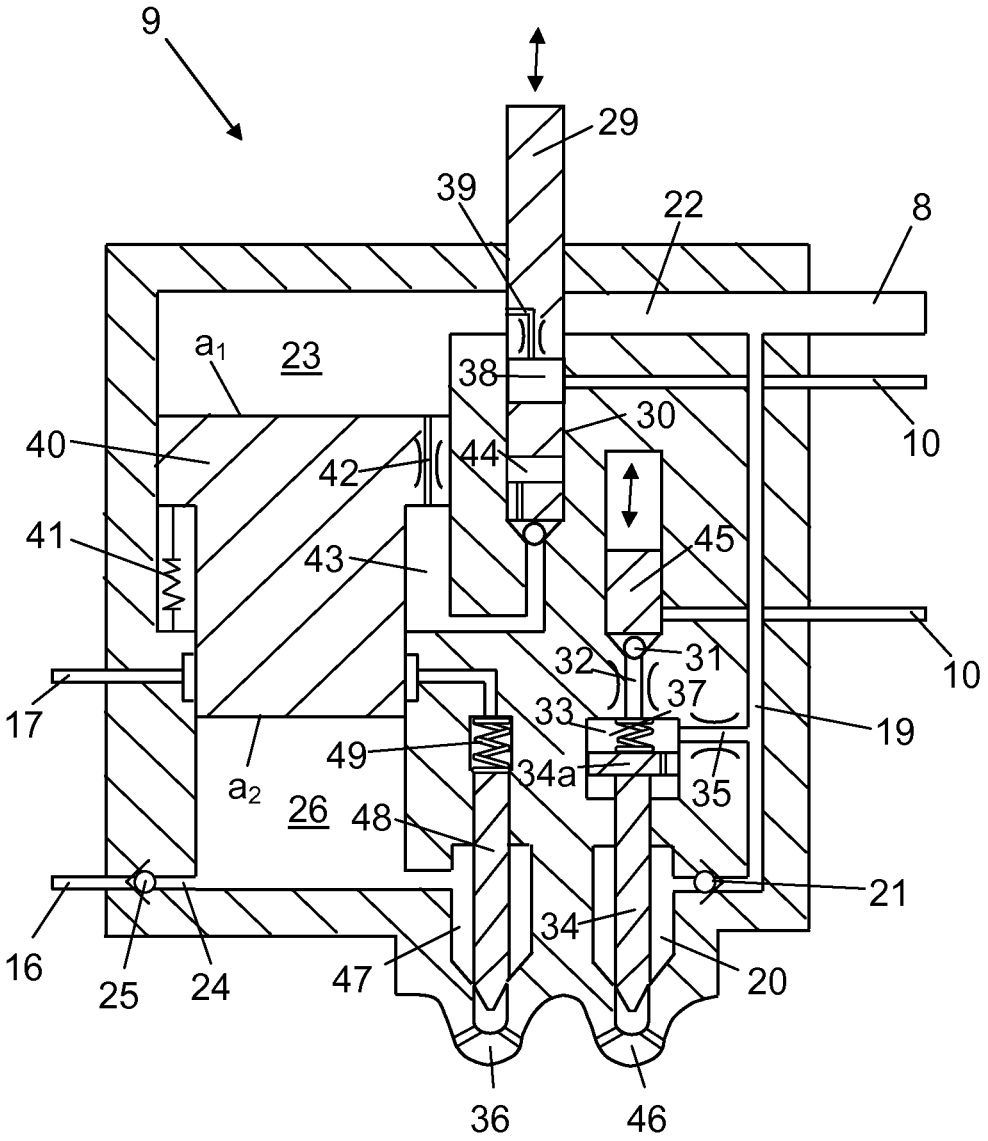

FIG. 7 depicts a further injection unit 9 which in this case comprises a first actuator 45, a second actuator 29, a first injection nozzle 46 and a second injection nozzle 36. The first actuator 45 is used to initiate the injection of the first fuel. The second actuator 29 is used to initiate the injection of the second fuel. The first injection nozzle 46 is used to inject the first fuel, and the second injection nozzle 36 to inject the second fuel. At times when no fuel is to be injected into the engine 1, the control unit 18 places the first actuator 45 in a lower position and the second actuator 29 in a lower position, as depicted in FIG. 7. This position of the second actuator 29 breaks the connection between the first accumulator tank 7 and the fuel space 23, but the pressurised first fuel is led to the injection chamber 20 via the fuel line 19 and the one-way valve 21. When the first actuator 45 is in the lower position, substantially the same pressure prevails on both sides of the needle valve's head 34*a* in the control chamber 33. The spring means 37 therefore keeps the needle valve 34 in the lower position with a spring force such that its lower end closes the passage between the injection chamber 20 and the first injection nozzle 46. When the first actuator 45 is in the lower position, the first injection nozzle 46 thus injects no first fuel in the combustion space.

The second fuel is led from the inlet line 16 to the fuel space 26 and the second injection chamber 47 via the fuel line 24 and the one-way valve 25. In the lower position, a second needle valve 48 closes a passage between the second injection chamber 47 and the second injection nozzle 36. When the second needle valve 48 is in the lower position, it thus prevents the second injection nozzle 36 from injecting the second fuel in the combustion space. When the control unit 18 estimates that a fuel injection process is to be initiated, it activates a power means to move the first actuator 45 to an upper position. This reduces the pressure in the upper portion of the control chamber 33 situated above the needle valve's head 34*a* relative to that in the lower portion of the control chamber 33 situated below the needle valve's head 34*a*. This pressure difference causes the needle valve 34 to move upwards to an upper position. The passage between the injection chamber 20 and the first injection nozzle 46 opens and the first fuel is sprayed out at a high pressure in the combustion space. When the injection of the first fuel is to end, the control unit 18 activates the power means to move the first actuator 45 to the lower position. This position of the first actuator 45 results in substantially the same pressure in the control chamber 33 on both sides of the needle valve's head 34*a*. The spring means 37 therefore moves the needle valve 34 to the lower position so that it closes the passage between the injection chamber 20 and the first injection nozzle 46. The injection of the first fuel therefore ceases.

When the control unit 18 estimates that an injection of the second fuel is to begin, a power means is activated to move the second actuator 29 to an upper position. This position of the second actuator 29 causes the hole 38 running through to assume a position in way of the fuel line 22. The first fuel from the first accumulator tank 7 is thus led to the fuel space 23 via the inlet line 8, the fuel line 22 and the hole 38. The first fuel exerts in the fuel space 23 a pressure on the piston 40 causing it to move downwards against the action of the spring means 41. The first fuel in the fuel chamber 23 thus pressurises the second fuel in the fuel space 26 via the piston 40. As the first surface $a_1$ of the piston 40 in contact with the first fuel is larger than its second surface $a_2$ in contact with the second fuel, the second fuel in the fuel chamber 26 acquires a higher pressure than the first fuel in the fuel chamber 23.

The fuel space 26 is connected to the second injection chamber 47. The pressure in the second injection chamber 47 therefore rises at the same rate as the pressure rise in the fuel space 26. When the pressure in the second injection chamber 47 reaches a specific value, the second needle valve 48 moves upward against the action of the spring means 49. The passage between the injection chamber 47 and the second injection nozzle 36 opens and the second fuel is sprayed out at a high pressure in the combustion space. When the injection of the second fuel is to end, the control unit 18 activates the power means to move the second actuator 29 to the lower position. The movement of the second actuator 29 from the upper position causes the hole 38 to assume a different position relative to the fuel line 22. The connection between the first accumulator tank 7 and the fuel space 23 ceases. When the second actuator 29 has moved to the lower position, the hole 38 assumes a position such that in conjunction with the throttle duct 39 it connects the fuel space 23 to a line in the return line system 10. The pressure in the fuel space 23 is thereby lowered. The spring means 41 moves the piston 40 upwards while at the same time the pressure in the second fuel space 26 is lowered. When the pressure drops below the predetermined value, the spring means 49 moves the second needle valve 48 to the lower position. The second needle valve 48 closes the passage between the second injection chamber 47 and the second injection nozzle 36, whereupon the injection of the second fuel ceases.

In this case the injection of the first fuel is controlled by the first actuator 45, and the injection of the second fuel by the second actuator 29. The injection of the first fuel and the second fuel may thus take place independently of one another. The amount of fuel injected and the times when it is injected may therefore be varied as desired. It is here also possible to inject the first fuel and the second fuel simultaneously for a specific period. It is also possible to inject the second fuel before the first fuel.

A common feature of the aforesaid injection units 9 is that the first fuel which is at a very high pressure in the first accumulator tank 7 is used to pressurise the second fuel which is at a relatively small positive pressure in the second accumulator tank 15. Thus the second fuel can also be injected at a similar high pressure. This means that no high-pressure pump need be used in the second fuel system. The second pressure accumulator may also be of simple configuration in that it only contains fuel at a relatively small positive pressure. Other components, e.g. lines, of the second fuel system may also be of relatively simple configuration in that they are not subject to the same high pressures as similar components in the first fuel system. The second fuel is also pressurised in the second fuel space 26 for only a short time for the purpose of injecting it into the combustion space. At other times the second fuel in the fuel space 26 will be at substantially the same pressure as in the second accumulator tank 15.

The invention is in no way confined to the embodiments to which the drawings refer but may be varied freely within the scopes of the claims.

The invention claimed is:

1. An injection unit for injection of a first fuel and a second fuel in a combustion space, the injection unit comprising:

at least one first internal fuel space for receiving the first fuel from a first fuel source in which the first fuel source is at a higher positive pressure, at least one second internal fuel space for receiving the second fuel from a second fuel source in which the second fuel source is at a lower pressure than the first fuel in the first fuel source;

an actuator movable between a first position and a second position, in the second position, the actuator being configured and operable to initiate injecting at least the second fuel in the combustion space, and an injection nozzle so connected and so configured and operable to inject at least the second fuel in the combustion space;

a control unit controlling the actuator;

a pressure boosting device configured and operable to apply the pressure of the first fuel source to increase the pressure of the second fuel to a higher level than the pressure in the second fuel source by means of the pressure of the first fuel, helm the se and fuel is injected into the combustion space by the injection nozzle; and a fuel passage configured and operable to lead the first fuel from the first fuel source tai the at least one first internal fuel space, and the actuator, is configured and operable to selectively close the fuel passage at times when the second fuel is not to he pressurized by the first fuel, and to open the fuel passage at times when the second fuel is to be pressurized by the first fuel, wherein the actuator is configured and operable to be moveable in a recess which extends transversely through part of the fuel passage, and the actuator is configured and operable to close the fuel passage when the actuator is in first position and open the fuel passage when the actuator is in the second position.

2. An injection unit according to claim 1, wherein the pressure boosting device is configured and operable to increase the pressure of the second fuel by means of the pressure of the first fuel at times when the actuator is placed in the second position.

3. An injection unit according to claim 1 wherein the pressure boosting device is configured and operable to increase the pressure of the second fuel to a pressure which is higher than that of the first fuel in the first fuel source.

4. An injection unit according to claim 1, wherein the pressure boosting device comprises a movable device having one side with a first surface in contact with the first fuel in the first internal fuel space, and an opposite side with a second surface in contact with the second fuel in the at least one second internal fuel space.

5. An injection unit according to claim 1 wherein the actuator is configured and operable to close the fuel passage at times when the actuator is in the first position and to open the fuel passage at times when the actuator is in the second position.

6. An injection unit according to claim 1, wherein the actuator has running through it a hole which opens the part of the fuel passage when the actuator is in the second position.

7. An injection unit according to claim 1, wherein the actuator is a shared actuator configured and operable to initiate injection of both the first fuel and the second fuel.

8. An injection unit according to claim 7, wherein, in the second position, the shared actuator injects the first fuel at a first time and injects the second fuel at a later time with a time delay relative to the injection of the first fuel.

9. An injection unit according to clam 8, wherein the time delay is substantially constant and is related to the amount of time required for the pressure boosting device to increase the pressure of the second fuel to the pressures in the second fuel source.

10. An injection unit according to claim 1, wherein the injection nozzle is a shared nozzle configured and operable to inject both the first fuel and the second fuel in the combustion.

11. An injection unit according to claim 10, further comprising a valve mechanism configured and operable to inject whichever fuel then has a higher pressure via the shared nozzle when an injection process of the unit has been initiated.

12. An injector unit according to claim 1, further comprising an extra actuator for initiating injection of the first fuel, and acting in addition to the actuator which initiates injection of the second fuel.

13. An injector unit according to claim 1, further comprising an extra injection nozzle for injecting the first fuel, and acting in addition to the injection nozzle which injects the second fuel.

* * * * *